US007636070B2

(12) United States Patent
De Lustrac et al.

(10) Patent No.: US 7,636,070 B2
(45) Date of Patent: Dec. 22, 2009

(54) CONFIGURABLE AND ORIENTABLE ANTENNA AND CORRESPONDING BASE STATION

(75) Inventors: André De Lustrac, Sceaux (FR); Kouroch Mahdjoubi, Noyal sur Vilaine (FR); Anne-Claude Tarot, Etrelles (FR); Halim Boutayeb, Montreal (CA); Claude Terret, Anglet (FR)

(73) Assignees: Centre National de la Recherche Scientifique, Paris (FR); Universite de Rennes 1, Rennes (FR); Universite Paris Sud (Paris XI), Orsay (FR)

( * ) Notice: Subject to any disclaimer, the term of this patent is extended or adjusted under 35 U.S.C. 154(b) by 378 days.

(21) Appl. No.: 10/580,338

(22) PCT Filed: Nov. 26, 2004

(86) PCT No.: PCT/FR2004/050622

§ 371 (c)(1),
(2), (4) Date: Jul. 25, 2006

(87) PCT Pub. No.: WO2005/055365

PCT Pub. Date: Jun. 16, 2005

(65) Prior Publication Data

US 2007/0080891 A1 Apr. 12, 2007

(30) Foreign Application Priority Data

Nov. 27, 2003 (FR) ..... 03 50925

(51) Int. Cl.
*H01Q 15/02* (2006.01)

(52) U.S. Cl. ..... 343/909; 343/833; 343/834

(58) Field of Classification Search ..... 343/810, 343/833, 834, 909
See application file for complete search history.

(56) References Cited

U.S. PATENT DOCUMENTS 3,560,978 A 2/1971 Himmel et al.
4,700,197 A 10/1987 Milne (Continued)

FOREIGN PATENT DOCUMENTS

EP 1 111 718 6/2001

OTHER PUBLICATIONS

Poilasne G et al: "Active Metallic Photonic Band-Grap Materials (MPBG): Experimental Results on Beam Shaper" IEEE Transaction on Antennas and Propagation, IEEE Inc. New York, US, vol. 48, No. 1, Jan. 2000, pp. 117-119, XP000908643 ISSN: 0018-926X the whole document.

*Primary Examiner*—Tan Ho
(74) *Attorney, Agent, or Firm*—Young & Thompson

(57) ABSTRACT

An antenna, permitting the configuration of at least one radio-electric wave beam of at least one fixed wavelength, of the type including at least one transmitting element, preferably of the passive type, arranged in a set of essentially parallel, wave-reflecting wires or bars, made from a photonic band gap (BIP) material and forming a given structure. The given structure includes faults for shaping the at least one beam in a direction as a function of the position and/or the configuration of the faults. The wires or bars and the faults are arranged on a set of N curves which are closed and concentric on a plane, N being greater than or equal to 1 and the transmitting element is arranged within the innermost curve. The curves are preferably circular and the wires/bars can be controlled to pass from a wave-conducting/reflecting state to a transparent state.

20 Claims, 8 Drawing Sheets

U.S. PATENT DOCUMENTS 5,689,275 A * 11/1997 Moore et al. ..... 343/786
5,767,807 A * 6/1998 Pritchett ..... 342/374
6,278,105 B1 * 8/2001 Mattia ..... 250/214.1
6,384,797 B1 * 5/2002 Schaffner et al. ..... 343/795
7,123,205 B2 * 10/2006 Ratajczak et al. ..... 343/773
7,242,366 B2 * 7/2007 Shibata ..... 343/893

* cited by examiner (a)

(b)

(c)

(d)

CONFIGURABLE AND ORIENTABLE ANTENNA AND CORRESPONDING BASE STATION

CROSS-REFERENCE TO RELATED APPLICATIONS

The present Application claims priority to and incorporates by reference PCT/FR2004/050622 filed Nov. 26, 2004 and French Patent Application No. 0350925 filed Nov. 27, 2003.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION

1. Field of the Invention

The present invention relates to a radioelectric antenna which enables to configure in space one or several lobes or beams, these terms being here equivalent, for transmitting/receiving electromagnetic waves and hence to configure its radiating diagram. It finds applications in the domain of the transmission/reception in radio electromagnetic waves and in particular as an antenna for mobile telephony. It enables in particular the shaping and the commutation of radioelectric beams or lobes within a base transceiver station of a telephony network or radiocommunication data transmission network with mobile stations as well in transmission as in reception (E/R).

2. Description of Related Art

Generally, to manufacture a directable shaped-beam antenna, there is provided on the one hand a structurally shaped-beam antenna and, on the other hand, it is moved in order to be directed in space, general in rotation, so that its electromagnetic radiation diagram is directed according to the direction requested. On top of the fact that the mechanical displacement of the antenna requires mechanical means which may be costly, are subjected to wear and are complex to be maintained, the antennas being generally in high locations and in severe weather conditions, the radiation diagram remains identical in its form throughout the rotation.

It is hence desirable to have non-mechanical means enabling to modify the orientation of the radiation diagram in space. Moreover, it also appears desirable to be able to modify the structure of the radiation diagram, in particular the number of transmission/reception lobes and/or their forms in space.

Indeed, for example in the case of new broadband radiocommunication services, it appears that only the dynamic systems fitted with smart antennas will enable optimal usage of the Hertzian spectrum while employing adaptation capacities of transmission/reception spatial configuration as shown in the articles "The path towards UMTS—Technologies for the information society", UMTS Forum 1998 and, "Une vue globale du concept d'UMTS" (a global view of the UMTS concept), S. Breyer, G. Dega, V. Kumar and L. Szabo, of Alcatel.

These smart antennas offer the possibility of increasing the capacity of the systems operating in particular in CDMA ("Code-Division-Multiple-Access") mode thanks to the use of a pseudo-SDMA ("Spatial-Division-Multiple Access") technique according to modalities known as described in the article "Smart antennas enhance cellular/PCS performance, part 1 & 2", C. B. Dietrich Jr. and W L Stuztman, in Microwaves & RF, April 1997. This technique enables to reduce the "co-channel" interferences in the downlink (base transceiver station towards the mobile phone) of the cellular networks in forming a shaped beam directed towards the mobile phone. It also enables rejection of the interferences in the uplink (mobile phone towards station base) with additionally the possibility of forming the diagram of the antenna of the base transceiver station so that it exhibits a reception valley in the direction of the interferences.

Generally two categories of so-called smart antennas can be distinguished and which have a variable radiation diagram: those made with beam-switching antenna networks and those made with adaptative antennas as presented in "Experiments on adaptative array diversity transceiver for base transceiver station application in W-CDMA mobile radio" par M. Sawahashi and S. Tanaka during the AP-S 2000, Salt Lake City, USA, July 2000.

The smart antennas made with adaptative antennas are generally constituted of a network of radiating elements controlled by a digital signal processor (DSP). They may adapt automatically their radiation diagram relative to the external signals received.

Unfortunately, the current digital technology does not appear mature enough for supporting the multiple frequency bands necessary in the mobile telephony, as well as the powers necessary for mastering this radio spectrum. Moreover, the technology of the smart and digital adaptative antennas is not very adapted to the existing technology in the base transceiver station BTS and hence would require too large investments to renew these as noticed in the presentation of M. Sawahashi quoted previously.

The smart antennas made with beam-switching antennas use the analogue synthesis of multiple beams. This approach keeps most features of the digital smart antennas, with however much smaller complexity and cost. It is compatible with the existing infrastructures (in particular the base transceiver stations) and enables significant increase in the capacity of the network with respect to the investment. Traditionally, the beam-switching antennas use a supply network with pre-set phase which provides several output ports corresponding, each, to a beam of fixed direction. Base transceiver stations of this type have been tried out by numerous companies in the United States and in Europe, in particular by: Celwave associated with BellSouth, Hazeltine Corp., Metawave Communications, ArrayConun Inc., Ericsson, Nortel, . . . . In addition to the articles and to the presentation quoted previously, information on that subject is also available in "Novel multiple-beam antenna array serves mobile BTS, part 1", L. Cellai and A. Ferrarotti, Microwaves & RF, August 1999 or in "Array antenna design for base transceiver station applications", B. Johannisson and A. Derneryd, Ericsson Microwave Systems AB.

The main shortcoming of this beam-switching technology is the great number of radiating elements and hence its cost. It has hence been suggested using an alternative solution to manufacture beam-switching type antennas while placing a passive radiating element at the core of a set of rods made of Photonic Band Gap (PBG) material, certain of these rods being rendered active by the insertion of switching components enabling, by an appropriate control, to force the rods to behave like discontinuous rods and for others such as continuous rods which exhibit different radioelectric features of the former. Information on this subject is available in the presentation "Beam switching smart antenna for hyperlan terminals" by A. Chelouah, A. Sibille, C. Roblin, during AP2000, Davos, April 2000, or, still, in the article of E. Yablonovitch in Physical Review Letters, vol. 58, n'20, 1987, p2059-2062.

This alternative solution does not involve any direct action on the excitation circuit of the radiating element but only on elements of its close environment, thereby limiting the losses. It is obtained by using the properties of the Photonic Band Gap (PBG) materials which are already known and for which articles have been published, in particular: "Photonic Band Gaps in experimentally realisable periodic dielectric structures", C. T. Chan, K. M. Ho and C. M. Soukoulis, Europhysics Letters, 16(6), pp 563-568, 7 Oct. 1991; or "Metallic Photonic band-gap materials", M. M. Sigalas, C. T. Chan, K. M. Ho and C. M. Soukoulis, Physical Review B, vol. 52, n'16, 15 Oct. 1995; or, finally, "Active Metallic Photonic B and Gap materials (MPBG): experimental results on beam shaper", G. Poilasne, P. Pouliguen, K. Mahdjoubi, L. Desclos and C. Terret, IEEE Trans. on Antennas and Propagation, January 1999.

The assembly of the rods forming the PBG material of this type of antenna is a periodic structure, so-called PBG structure, composed mainly of parallel conductors and wherein a radiating element acts. The electromagnetic features of this PBG structure depend mainly on the transmission/reception frequency of the radiating element. Its frequency response at a planar wave exhibits alternately frequency bands authorising or not propagation through the PBG structure. The response duality between a PBG material composed of continuous rods and a PBG material composed of discontinuous rods has been studied. These differences have been exploited for obtaining the switching and the spatial shaping of the radiation diagram by passing from one to another, continuous or discontinuous rods, of these PBG structures. It is thus that the presentations and articles have been produced in this field as in particular: "Numerical and experimental demonstration of an electronically controllable PBG in the frequency range 0 to 20 GHz", par A. De Lustrac, T. Brillat, F. Gadot, E. Akmansoy, during AP2000, Davos, avril 2000; and in "Experimental radiation pattern of dipole inside metallic photonic band-gap materials", of G. Poilasne, P. Pouliguen, K. MahdJoubi, C. Terret, P. Gelin and L. Desclos, in Microwave and Optical Technology Letters, vol. 22, Issue 1, July 1999.

Currently, the PBG structures with square meshed are used. In other words, and as illustrated on FIG. 1 (cross-section with respect to the axis of the rods), the rods 1 constitute a square-mesh grid at the centre of which the passive radiating element 2 is situated.

It appears that this PBG material with square meshes exhibit two major shortcomings. First of all, it is ill-suited to excitations by cylindrical waves, hence a difficult study when a radiating element is placed at the centre of a PBG material with square meshes. Besides, it does not enable to create a constant beam rotating round 3600 with any pitch and any angle.

BRIEF SUMMARY OF THE INVENTION

The invention which is suggested aims in particular at remedying the shortcomings of the state of the art regarding the antennas of the type implementing a Photonic Band Gap (PBG) material and forming a determined structure which may be qualified as photonic crystal. The antenna of the invention may be used for directing and/or shaping a unique beam or several simultaneous beams. It may also be used for shaping and switching different beams: it is then possible to mention a beam-switching antenna.

Basically, the antenna of the invention sticks out from the antennas made of PBG material known in that the implantation of the elements (wires/bars) within the antenna and around the radiating element does not follow a square mesh grid but a distribution along concentric closed curves relative to one another at the centre of which the radiating element is situated. The form of the closed curves is preferably circular (circles) but it may be more complex in particular of ellipse, cycloid type or other rounded curves. The form of the elements building up the antenna (radiating element and/or the wires/bars) is preferably linear but it may be different and in particular curved for the wires/bars.

Thus, the invention relates to an antenna enabling the shaping of at least one beam of radioelectric waves of at least one determined wavelength, of the type comprising at least one radiating element the waves, preferably passive, placed in a set of wires or bars reflective the wave and substantially parallel to one another, made of a Photonic Band Gap (PBG) material and forming a determined structure, said determined structure including defects so as to shape said at least one beam in a direction relative to the position and/or of the configuration of said defects.

According to the invention, the wires or bars and the defects are arranged on a set of N concentric closed curves of a plane, N being greater than or equal to one, the radiating element being arranged inside the innermost curve.

In various embodiments of the invention, whereas the following means may be combined according to all the possibilities which may be contemplated technically, are employed:

- the curves are selected among the circles, the ellipses, the cycloids and, preferably, are all circles, the radiating element being placed substantially in the common centre of the circles;
- the maximum distance separating the innermost curve (in practice a wire/bar on the innermost curve) and the radiating element is smaller than or equal to a quarter of the wavelength (of the smallest wavelength in the case when several wavelengths are possible),
- the distance separating the innermost curve and the radiating element is greater than the quarter of the wavelength (of the smallest wavelength in the case when several wavelengths are possible), in order to reduce the weight and/or the manufacturing cost and/or to facilitate the impedance adaptation, etc.
- the maximum distance separating two successive contiguous curves (in practice two wires/bars close to two curves along a direction running through the radiating element) is smaller than or equal to a quarter of the wavelength (of the smallest wavelength in the case when several wavelengths are possible),
- the wires/bars or defects adjoining a given curve are arranged in transversally equidistant locations (corresponding to a constant transversal period in the case of a curve which is a circle);
- the transversal distance of the adjoining wires/bars or defects are all equal for all the curves (corresponding to a constant transversal period, equal for all the circles in the case of curves which are circles);

the curves are circles and the wires/bars or defects are arranged in at least two concentric circles around the radiating element substantially central according to a constant transversal periodic distribution, equal for all the circles;

the wires/bars or defects are arranged along distribution axes running through the radiating element and in the plane, in locations corresponding to the crossing of the curves and to the distribution axes (corresponding to a constant angular period and the wires/bars or defects are arranged systematically or not at the crossing points of the distribution axes and of the curves);

the distribution axes are spaced regularly in the plane over 360° and divide it into equal angular sectors, the value of an angular sector being preferably 22.5° or a multiple of 22.5°;

the curves are circles and the wires/bars or defects are arranged in at least two concentric circles around the radiating element substantially central according to a constant angular periodic distribution and equal for all the circles;

the wires/bars or defects are arranged according to an association of constant transversal period arrangement and of constant angular period arrangement, the radiating element is directional;

the radiating element is omnidirectional and is preferably a dipole, said dipole being than arranged substantially parallel to the wires/bars;

the radiating element is omnidirectional and is preferably a monopole arranged on a ground plane, said monopole being than arranged substantially parallel to the wires/bars, each of the wires/bars being connected to one of both its ends to the ground plane, in the case of a monopole and of wires/bars with conductive segments separated by insulators including or formed of switchable active components, the wires/bars are connected to the ground plane via insulators, in the case of a monopole and of wires/bars with conductive segments separated by insulators including or formed of switchable active components, the wires/bars are connected to the ground plane via the segments the wires/bars are straight;

the wires/bars are curved;

the wires/bars have straight portions, in circles, ellipses, triangles, squares or rectangles;

the defects are realised by removing at least partially certain of said wires/bars, the at least one beam being shaped in a direction relative to the position and/or to the configuration of the wires/bars withdrawn;

at least certain of the wires/bars are each formed of at least two conductive segments, the maximum length of a segment being smaller than a quarter of the wavelength (of the smallest wavelength in the case when several wavelengths are possible) and preferably smaller than or equal to the tenth of the wavelength, the adjoining segments of a wire/bar being separated by insulators (at least insulator for the wave), each wire/bar with several insulated segments (at least for the wave) therebetween, designated discontinuous wire/bar, being transparent for the wave and equivalent to the defect of a wire/bar at least partially withdrawn;

a wire/bar may include at least one section formed of a succession of segments separated by insulators and at least one other section composed of a continuous reflecting conductor, the use of the addition/removal of wires/bars may be combined to the implementation of wires/bars with segments;

all the wires/bars are wires/bars with several segments;

at least one of the insulators separating two adjoining segments in a wire/bar comprises or is formed of a switchable active component which may adopt at least one first conductive state for the wave, wherein the wire/bar with several segments behaves like a conductor/reflector for the wave designated as a continuous wire/bar, and a second insulating state for the wave wherein the wire/bar with several segments is transparent for the wave and equivalent to the defect of a wire/bar at least partially withdrawn, and in that said antenna includes moreover control means of the active components, enabling to force certain of the wires/bars with several segments to behave like discontinuous wires/bars, the at least one beam being shaped in a direction relative to the position and/or to the configuration of the discontinuous wires/bars;

in a wire/bar with segments and active switching components, the control is conducted by section(s) formed of a sub-set of adjoining segments of the assembly of the segments of the wire/bar, whereas the sub-assembly may comprise from two up to the total number of segments of the wire/bar, the components separating the segments of a section being placed into their first state, the other components being in the second state, in order to be able moreover to direct the beam(s) in height relative to the plane;

the control means of the active components constitute shaping and switching means between at least one first beam and at least one second beam, so that the antenna is a beam-switching antenna;

the antenna is applied to a public or private civilian telecommunication network.

The invention finally consists of a base transceiver station which includes at least one beam-switching antenna according to one or several of the previous features.

The invention hence consists of a tunable electromagnetic material derived from the Photonic Band Gap (PBG) materials and possessing preferably a cylindrical symmetry. This material will be called thereunder tunable shaped PBG material (TSPBG). The main destination of this material is the use as active deflector in antennas of base transceiver stations, in particular for the civilian telecommunication networks (GSM and UMTS).

According to another presentation of a modality of the invention, the antenna is performed by surrounding a radiating element of the electromagnetic waves (preferably omnidirectional at least in a plane xy) of a structure of a bar or wire type Faraday cage which are perpendicular to the plane xy (and parallel to the radiating element), whereas each of the bars of the cage may be rendered conductive for the waves selectively, it then appears as a reflector of the electromagnetic waves, in all or by section(s) of great length (continuous state) or be conductive solely over very small segments (discontinuous state), the segments being separated from one another by insulators and the segments being of such a length that the bar then appears substantially transparent for the waves.

From a theoretical viewpoint, it is preferable that the total length of the bars in the continuous state is great with respect to the wavelength of the waves to be transmitted or to be received, since they then appear in a conductive state regarding said waves which enables to prevent (to limit) by reflection the output thereof outside the antenna. It should be understood that in this case of great length with controllable wires/bars (in particular via components which are diodes), it is necessary to use numerous components. It should be noted however in practice that, surprisingly, shorter lengths of the wires/bars could be used advantageously and it is thus possible to use lengths of wires/bars greater than or equal to half the wavelength. The use of shorter lengths than from a theoretical viewpoint enables to reduce the number of components without any consequent degradation of the features of the antenna. It has then been possible, by way of example, to provide an antenna intended to operate on 1 GHz whereof the length of each wire/bar is approx. 17 cm. Thus, the term <<great >> for the length of the wires/bars (or conductive/reflective continuous sections of the waves) should be considered more under a functional aspect than of pure length since antennas with wires/bars may be realised in a length which may be reduced up to half the wavelength and whereof the continuous wires/bars behave like conductors/reflectors of the waves.

The length of the segments is qualified as very small with respect to the quarter of the wavelength of the waves to be transmitted or to be received, the segments being insulated from one another, the bars in this state are globally non-conductive regarding these waves and then appear substantially transparent for these waves.

In an embodiment, whereas each of the bars may be rendered conductive/reflective (continuous state) or non-conductive/transparent (discontinuous state) regarding the waves is of the type with very small segments separated by radioelectric insulators with, parallel to the insulators, switching means enabling for electric continuous and alternative connection or solely alternative connection (capacitive link for example) in twos of the adjoining segments of an insulator. It should be noted that the term switching means parallel to the insulator corresponds to the case when an insulator is still present (a switch being controlled parallel to an insulating spacer), as in the case when the insulator becomes conductive (a diode for example). For reasons of simplification, it is preferable to use between the segments a component which may be switched upon request from a conductive state to an insulating state of the electromagnetic waves, such as a diode.

Below, terms wire or bar may be used indifferently to designate (radio)electric conductive/reflective or non-conductive/transparent elements of the structure of the antenna. In practice, relative to the frequencies implemented by the antenna, it may be preferable to use bars for the very high frequencies for which skin effects present rather than wires. Moreover, the bars may be hollow and enable internally the passage of links in particular electric for the control of active switching components between insulated segments of the bar, whereas these links may be thus shielded partially by the presence of the bar.

On the other hand, the term (radio)electric is used for defining the conductive/reflective state or the non-conductive/transparent state of the wires/bars globally and conductive or non-conductive state of the active switching components specifically since if, at least, the conduction or non-conduction should concern the radioelectric (alternative) waves, these elements may be moreover conductive or non-conductive with respect to a possible direct current. Indeed, a capacitive link, for example in an active switching element, is conductive for the radio waves but insulating for the direct current, a switching operation may be provided while varying the value of the capacity (varicap). Similarly, an inductive link, for example in an active switching element, is non-conductive for the radio waves but conductive for the direct current, a switching operation may be provided while varying the value of the inductive link. It also possible to associate capacitive and inductive components in trap (non-conductive) circuits forming active switching elements and whereof the values of the components may be varied to render them conductive. In order to improve the behaviour of the antenna, it is also possible to correct the presence of spurious capacities (in particular for the diodes) or spurious self-induction (in particular for the connections of the diodes), by additional corrective components, in particular self-inducting coils against the spurious capacities and a capacity against the spurious self-inducting coils, possibly combinations of these components.

These active switching components may for example be diodes rendered conductive or not according to the application or not of a current. According to their type, the active switching components may be conductive or non-conductive at rest (a non-biased diode, at rest, is non conductive while neglecting its spurious capacity).

The antenna of the invention in the preferred case of a distribution of the layers of wires/bars in concentric circles is particularly well suited to the excitations by cylindrical waves produced by a radiating element of the dipole type placed at the centre thereof. According to its configuration, it enables to provide at least one given opening radioelectric (lobe) beam, liable to rotate over 360°. Indeed, in particular for the UMTS network, the antennas should be capable of having a directable shaped radiating beam over 360°, liable to follow a user as he/she moves. The antenna of the invention, in particular in its preferred configuration of circular (cylindrical) layers, is simple to implement and relatively cheap.

It should be mentioned here that in the current antennas of the base transceiver stations, the direction of the beams is fixed and does not enable the operators to adapt to the telephone traffic. The PBG material according to the invention and preferably in its form with a PBG cylindrical material and in the case when it may be controlled, enables to obtain flexibility of the beam. This enables to follow the mobile phones, to modify dynamically the covering zones relative to the requirements of the moment, to give priority to a given sector at the rush hours, etc.

BRIEF DESCRIPTION OF THE SEVERAL VIEWS OF THE DRAWINGS

The present invention will now be exemplified by the following description, without being limited thereto, and in relation with.

DETAILED DESCRIPTION OF THE INVENTION

Figure 1:
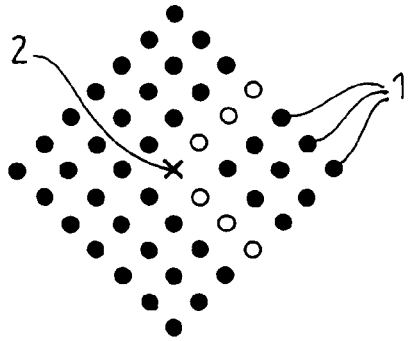
FIG.1 Prior Art
FIG. 1 which represents a cross-sectional view of an antenna including a PBG material of the state of the art with square meshes.

In opposition to the known antennas and in particular as seen in the section relative to the prior art regarding an antenna with a PBG material with square meshes as represented on FIG. 1 where the rods 1 constitute a grid (seven lines×seven column) with square meshes at the centre of which the passive radiating element 2 is situated, the antennas of the invention have a structure based on a distribution over circular curves (circle, ellipse or other closed circular curve) concentric of wires or bars forming each a layer around a radiating element substantially central to the curves. Typically, in an antenna of the invention, a radiating element (in particular a dipolar simple antenna) is arranged along an axis z and is surrounded with a structure of wires or bars typically linear and parallel therebetween and to the axis z. Preferably and as represented on Figures, a PBG material is implemented whereof the distribution of the wires or bar is conducted on concentric circles around a centre where the radiating element is substantially situated. The radiating element and the wires/bars are perpendicular to a medium plane xy of the structure which, in a basic operating mode, carries great axes of the transmission/reception beams (lobes) which may be created (in other operating modes, the great axes may be located above or below), with a particular lobe shape and an angular position around the particular axis z depending on the distribution and on the conductive/reflective or non-conductive/transparent states of the wires/bars.

The term radiating element is used here for designating the final transmission device in the radioelectric wave space of a transmitted as well as the collection device in the space of the electromagnetic waves of a receiver, devices which are preferably gathered in a single structure (same device for the transmission and the reception) but which, in certain configurations, may be formed of two distinct devices or be used only for transmission or for reception (if realising an antenna specialised in transmission or in reception). The radiating element is for example a dipole, preferably passive. To cover a wide passband (for example the UMTS band), the radiating element may be a thick dipole or a folded dipole of printed technology.

Each wire or bar is preferably formed of adjoining electric conductive segments separated from one another by insulators including, in parallel, active switching components (controlled active components) which may ensure the (radio)electric continuity of the adjoining electric conductive segments. Thus, each wire or bar may be conductive per sections or in its entirety (continuous state appearing conductive/reflective for the waves) or be left formed of conductive segments insulated from one another (discontinuous state, appearing non-conductive/transparent for the waves). The possibility of rendering conductive or not per sections of the wires/bars enables moreover to direct the great axis of the lobe(s) in height relative to the plane xy for a volume scan of the space. As indicated, this reflection or transparency effect relates to the waves and the lengths of the wires/bars, segments and sections are adapted to the wavelengths involved so that said effects are present regarding waves.

In certain embodiments, only a section of the wires or bars is of the previous type formed of conductive segments which may be connected (radio)electrically therebetween by controlling switching components, the other segments being either non-conductive/transparent or, more simply, being omitted, or conductive/reflective over a whole section or a great section (large with respect to the wavelength) of their total length. It should be understood that in the case when wires/bars are of a fixed, conductive/reflective or non-conductive/transparent type, it is not possible any longer to control it and, apart from manual operations, it is not possible to modify by control the shape and the direction of the lobe(s) over the whole antenna (if all the wires/bars of the antenna are of a fixed type) or a section of the antenna (if only a section of the wires/bars of the antenna is of a fixed type, whereas the other wires/bars may be controlled).

An additional advantage in having electric conductive segments separated from insulators which may be rendered conductive by section-operated switching elements is to enable the realisation of a wideband antenna or a logarithmic-type antenna, the length of the section rendered conductive being adapted to a particular frequency. Thus, it is not only possible to direct in height the lobe relative to the plane xy, but also to adapt the operation of the antenna to a wide range of frequencies.

It has been seen hence that the wires/bars of the structure of antenna of the invention are arranged in concentric layers and, preferably, each circular element (a circle in the plane xy or a cylinder in the space xyz) whereof the single centre of the structure and of the circles correspond substantially to the radiating element. In an embodiment, the wires/bars are arranged from one layer to the other in the plane xy along carrying axes in radii (distribution axes) running through the centre of the structure (or in planes zw in the space xyz; w being a straight line centred in the plane xy). Preferably, these carrying axes in radii are regularly arranged angularly in the plane xy, for example every 90°, 45°, 30° or 22.5°, possibly more or less and more generally any value corresponding to a division of the plane xy around the centre into equal angular portions. If it is preferable that the wires/bars of a layer are spread around the centre in equi-angular positions (for example all the 30°), the case of non-equi-angular distributions is contemplated however, whereas the wires/bars may be brought closer angularly in certain sections of the plane xy in order to increase the tracking accuracy of the lobe(s) in said sections with respect to the other sections.

Thus at each intersection of the carrying axis in radius and of a circle of a layer, a wire or bar is present. It should be understood that these circles (cylinders) and axes (planes) are virtual and intended to facilitate the explanation of the implantation of the wires or bars to form the structure.

In a variation, the wires/bars are arranged regularly with a transversal distance between two adjoining wires/bars (distance along the straight line joining both of them) of an equal given circle along said circle and, possibly, for all the circles. As previously, in certain sectors the transversal distances may be different.

In practice the wires or bars as well as the radiating element are held therebetween by hardware means in order to keep a stable structural configuration. These means are typically spacers joining the wires/bars and the antenna or a common support. These means may be drilled discs through which the wires/bars are held with respect to the radiating element. These means may still fulfil completely the structure of the antenna. These means are realised in low-loss materials for the frequencies involved by the antenna and are in particular plastic materials, special glasses or special ceramics and, for example foams, expanded polystyrene, resins, TEFLON® . . . .

It has been seen that in certain configurations it is possible to have a ground plane at an axial end of the antenna and in particular when the radiating element is a monopole (ground plane radiating element), the radiating element being then laid substantially perpendicular to the ground plane and insulated therefrom. In such a configuration, it is possible to use this ground plane as a means for maintaining the wires/bars which will be then fixed at one (lower) of both their ends to said ground plane and preferably connected (or which may be connected electrically in particular by the switching components in the case of wires/bars with segments) to the ground plane. Since it is also possible to have one or, preferably, two ground planes (at both axial ends, at the bottom and at the top of the antenna), regardless of the type of the radiating element (dipole, monopole or other), this(these) end ground plane(s) may also be used as a mechanical means for maintaining the wires/bars. In the case of simultaneous electric connection of all the wires/bars to both ground planes (upper and lower) prohibits any control of the wires/bars with segments operated (in particular with diodes) by a direct voltage (<<DC>>), a control which would enable to switch it from a continuous state, to a discontinuous state and conversely. It is hence preferable to provide spacers for insulating electrically the wires/bars of one of both ground planes while ensuring mechanical maintenance, the spacers providing at least for the insulation for a direct current (any electric insulating material may be used, bearing in mind that a capacitor is insulating for the direct current).

It should be noted that the term ground plane means a continuous surface as well as a discontinuous surface. Indeed, if from a theoretical viewpoint, a continuous surface is ideal, it is also possible to implement the wire or meshed ground planes without net degradation of the characteristics of the antenna. These wire ground planes behave like horizontal continuous conductive wires/bars, i.e. perpendicular to the radiating element and to the wires/bars of the PBG/TSBPG material, joining the latter and connected to the ground. A description of such a structure of antenna will be shown below with FIG. 11. The presence of ground planes at both, upper and lower, axial ends of the antenna enables to limit the propagation of the waves in both these directions.

The distance between the layers of wires/bars and the length of the segments along the wires/bars depends on the transmission wavelength of the antenna. If the antenna transmits at a given wavelength, the distances between the concentric layers will be equal to one another or different, providing these distances are vastly smaller than the wavelength and better, smaller than a quarter of the wavelength. For example for a frequency f=1 GHz, the wavelength in the air is 30 cm. The length of a segment of a wire/bar is of the order of a few centimeters (2.5 cm in the example considered here). These wires/bars are arranged in concentric layers from the central axis of the antenna. These layers are separated by a distance which must be smaller than a quarter wavelength (7.5 cm for the 1 GHz example). The wires/bars are preferably arranged along the radii of concentric cylinders. The number of these radii, and hence the angle which separates them, has been selected relative to the application considered and, in practice, the smaller the angle the more precisions may be obtained regarding the shape and the angular direction of the lobe(s). A radiating element is placed at the centre of the antenna.

The radiation of the antenna will be controlled by the TSPBG material. The arrangement of the radii, the number of layers and the number of switched wires/bars determine the shape (width) of the beam radiated by the antenna. In the case of diode-type switching components, the metallic wires/bars comprise between the segments of the diodes which may be rendered conductive (state of a continuous wire/bar hence conductive/reflective for the waves) or non-conductive (state of a discontinuous wire/bar hence non-conductive/transparent for the waves) while acting on the biasing of these diodes. A direct current biases these diodes. When the current is sufficient, the diodes are in the conductive state, their internal resistance is low and the wire/bar is in a continuous state (radioelectric conductive/reflective). When this current is broken off, the diodes are blocked and the wire adopts a discontinuous state (radioelectric non-conductive, transparent for the waves).

The operating principle is as follows. The material behaves like a metallic PBG operating in its first band gap. When the metallic wires/bars forming it are in the continuous state (conductive diodes for example), the material is reflecting and the radiation of the antenna placed at the centre is confined inside. When the wires/bars are in the discontinuous state (diodes blocked for example) the material becomes transparent for this radiation solely in the region where these wires/bars are in the discontinuous state. If the state of the switching components can be controlled (diodes for example) between the adjoining segments of the wires/bars over the whole material, the material or a section of this material can be made transparent and the direction wherein the antenna will transmit or receive may therefore be controlled. Modellings carried out using two industrial electromagnetic simulators (NEC® and HFSS®) have demonstrated the validity of this operating and designing principle of the material.

When the dipolar-type radiating element is single, its radiation diagram is omnidirectional in the direction normal to the radiating element which runs along the axis z. Antennas with circular (cylindrical) layers with a number of layers increasing from 1 to 6 could be simulated, the radiating dipolar element being central, and with wires/bars arranged every 45° along circles (the wires/bars are aligned on the radii). To control the direction of transmission, the wires/bars arranged along a single radius are all placed in the discontinuous state (transparent for the waves), the other being in the continuous state (conductive/reflective for the waves). The simulated antenna uses a central radiating element of the dipolar type operating at 1 GHz. The radiation diagram comprises a lobe which is fine-tuned in the radiation direction when the number of layers of wires/bars of the material is increased.

The wires/bars may also be arranged every 30° and rendered discontinuous along two directly neighbouring radii. If the number of layers is sufficient, the beam will be more directing than in the previous case of a 45° angular arrangement. Other simulations have been carried out for a 2 Ghz operation and a dipolar radiating element and this, for angular distributions every 45° and 22.5° on the circular layers. As previously, the radiation diagram only comprises a lobe in the direction of the wires/bars of a radius in a discontinuous state.

Thus, in the antenna of the invention, the radioelectric radiating element is preferably passive and it is placed at the core of an assembly of conductive wires/bars substantially parallel to one another and made of a Photonic Band Gap (PBG) material and forming a determined structure of wires/bars. This structure of the antenna formed of wires/bars surrounding a radiating element comprises defects with a type of wires/bars exhibiting (radio)electric features different from one another, in particular conduction/reflection or non-conduction/transparency, so as to shape at least one beam (or lobe) in a direction relative to the position and/or to the configuration of said defects.

The defect corresponding to different (radio)electric features (conductive/reflective or non-conductive/transparent wire/bar regarding the waves) which may be obtained in various ways, several embodiments are possible and two main ones are given by way of example. It should be understood that the term defect may have two meanings relative to the context. The first, which will be used below, corresponds to the case when in an antenna comprising initially conductive/reflective wires/bars, the defect is the presence of non-conductive/transparent wire/bar or the omission of conductive/reflective wires/bars. The second, reverse of the previous one, corresponds to the case when the defect is a conductive/reflective wire/bar.

In a first embodiment of the invention, said defects are realised by removing certain of said conductive wires/bars, said at least one beam being shaped in a direction relative to the position and/or to the configuration of the wires/bars withdrawn. Removing a wire/bar may be carried out in its entirety or in section so as to be able to direct the beam in height relative to the plane xy. The conductive wires/bars are either really continuous, or of the type with segments separated by insulators with active switching components and placed into a continuous state (conductive/reflective with respect to the waves).

In a second implementation of the invention, at least certain of the wires/bars are with several segments separated by insulators which may be short-circuited by active components controlled and enabling when the active components are in a conductive state, in short-circuit (radio)electrical, that the wire/bar behaves like a (radio)electric conductor/reflector (continuous state) state and when the active components are in an insulating state, the wire/bar behaves like a (radio) electric non-conductive/transparent (discontinuous state) state equivalent to a wire/bar at least partially withdrawn. The antenna comprises preferably control means of said active switching components, enabling to force certain of the wires/bars with segments to behave like discontinuous wires/bars (non-conductive of the waves, transparent) and others like continuous wires/bars (conductive/reflective of the waves). The defects are here wires/bars behaving like discontinuous wires/bars and a beam may be shaped in a direction relative to the position and/or to the configuration of the discontinuous wires/bars. In this second implementation of the invention, the PBG material of the antenna is hence active in that it enables to shape dynamically and easily one or several beams or lobes (radiation diagrams). No manual manipulation for removing a wire/bar is necessary here.

It should be noted that both these possibilities of implementation may be combined, whereas a section of the wires/bars can be controlled, the remainder should be manipulated for removal or addition to be able to modify the radiation diagram. Indeed, if, advantageously, all the wires/bars of the PBG material of the antenna are with several segments insulated from one another and with active switching components in parallel to the insulators, it is clear however that the invention also covers the case when solely certain wires/bars are active, i.e. formed of several insulated segments whereof the insulator comprises in parallel a active switching component.

Advantageously, said control means of the active switching components constitute shaping and switching means between at least one first beam and at least one second beam, so that said antenna is a beam-switching antenna. The beam-switching antenna according to the invention enables to realise one or several given opening beam(s), liable to rotate (i.e. switchable) over 360°, with any pitch and any angle relative to the angular distribution of the wires/bars within the PBG material of the antenna. Preferably, the wires/bars are arranged on circles according to a constant angular period, and consequently according to a variable transversal period, for each concentric layer.

Numerous arrangements of the wires/bars, according to concentric layers along closed circular curves may be contemplated without departing from the framework of the present invention and we shall now describe more in detail antennas with layers in concentric circles of the PBG cylindrical material type. On FIGS. 2 to 5 and 9 discussed below, the radiating element 2 and the wires/bars 1 are seen as an upper (or lower) transversal section of the plane xy, said plane being in the plane of the sheet whereon the figures are realised. On these same figures, the wires/bars are arranged along concentric circles or layers around the radiating element 2.

Generally, the different parameters of the PBG cylindrical material are

- Pθ: the angular period (in °), i.e. the angular distance between two adjoining wires/bars of a given circle;
- Pt: the transversal period (in mm), i.e. the interval between two adjoining wires/bars of a given circle;
- Pr: the radial period (in mm), i.e. the interval between two adjoining circles;
- d: the diameter of the conductive wires/bars (in mm);
- n: the number of concentric circles (layers).

Later in the description, it is assumed that the wires/bars are arranged periodically according to a constant radial period Pr and, for each concentric circle, according to a constant angular period Pθ (and consequently according to a variable transversal period Pt).

Figure 2:
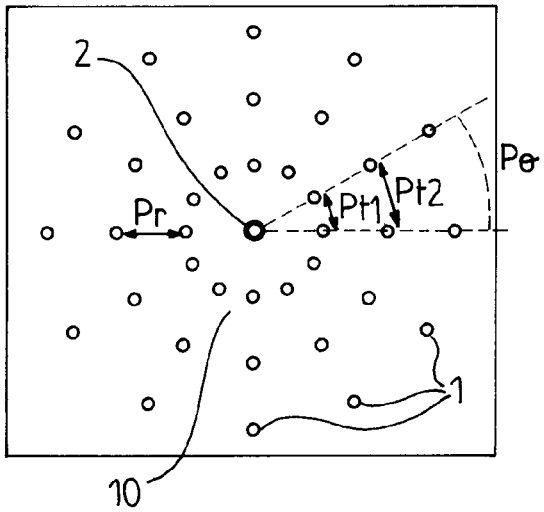
FIG. 2 which represents a first particular embodiment of a PBG cylindrical material according to the invention.

As illustrated on FIG. 2, in a first embodiment of the PBG cylindrical material according to the invention, the angular period Pθ is identical for all the concentric circles. Consequently, the transversal period Pt varies from a circle to the other (Pt1<Pt2). On this FIG. 2, it may noted that the internal circle comprises wires/bars particularly brought closer to one another and in this type of configuration, it is this internal circle which controls essentially the frequency characteristics of the antenna. Such a structure of antenna is rather intended for single band applications.

Figure 3:
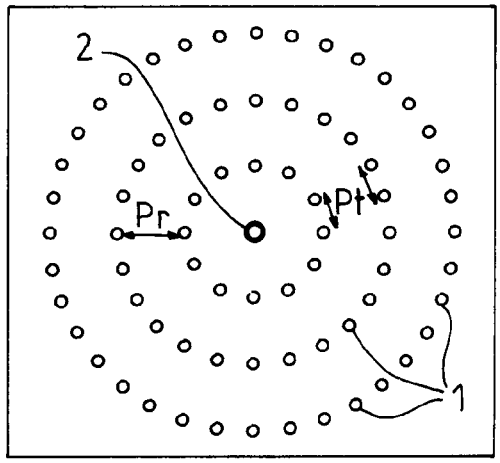
FIG. 3 which represents a second particular embodiment of a PBG cylindrical material according to the invention.

In a second embodiment, illustrated on FIG. 3, it is the transversal period Pt which is identical for all the concentric circles. The angular period PO varies hence from a circle to the other. In this type of structure, the assembly of the circles influences the frequency response of the antenna and such an antenna is rather designed for multiband applications. It should also be noted that the number of transmission peaks is proportional to the number of concentric layers.

The PBG cylindrical material should comprise moreover defects (wire/bar in a discontinuous state, non-conductive of the waves and hence transparent for these waves) so as to create (at least) a beam in a direction relative to the position and/or to the configuration of these defects within a PBG structure essentially composed of wires/bars in a continuous state (conductive/reflective of the waves).

A first simple technique to manufacture defects in the PBG cylindrical material consists in removing metallic wires/bars locally. Relative to the position and to the configuration of the wires/bars withdrawn (defects), one may select the width, the direction and the number of useful beams.

Figure 4:
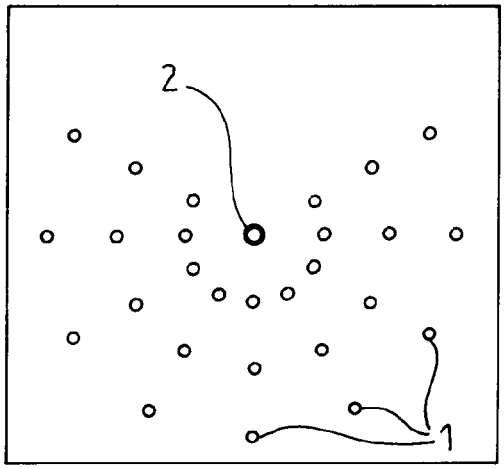
FIG. 4 which represents an example of antenna according to the invention including a PBG cylindrical material according to the first embodiment illustrated on FIG. 2 and with defects obtained by removing wires/bars.
Figure 5:
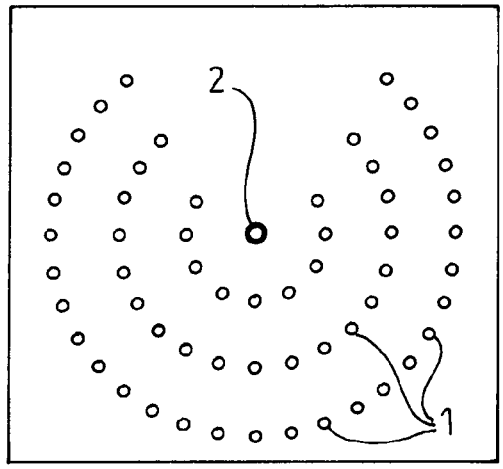
FIG. 5 which represents an example of antenna according to the invention including a PBG cylindrical material according to the second embodiment illustrated on FIG. 3 and with defects obtained by removing wires/bars.

FIGS. 4 and 5 illustrate the structures obtained by removing wires/bars in an angular sector of the PBG material.

Figure 6:
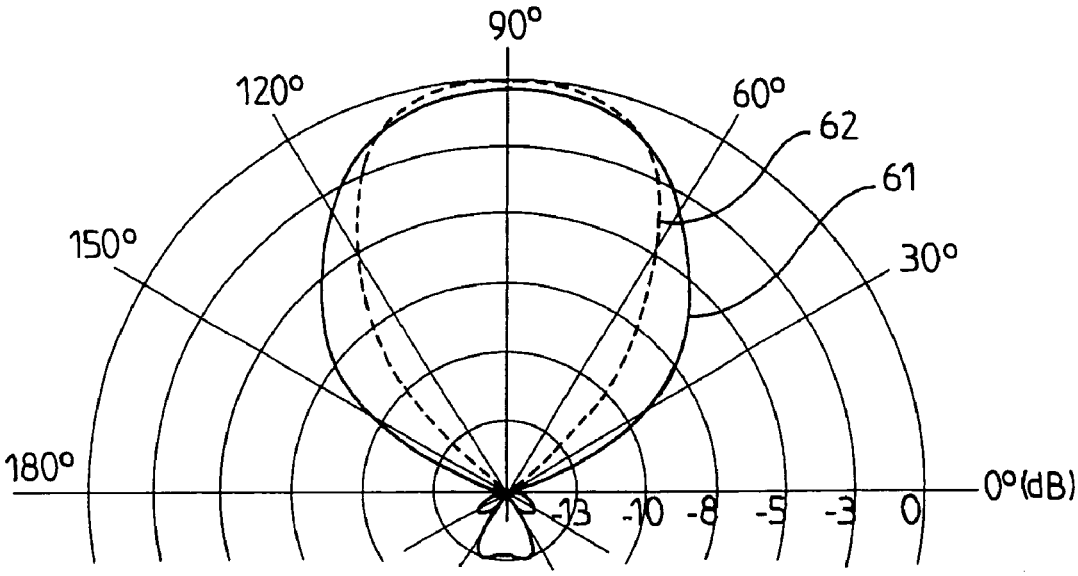
FIG. 6 which represents radiating diagrams obtained for the antennas of FIGS. 4 and 5.

The radiation diagram obtained for the antenna of FIG. 4 is referenced 61 on FIG. 6. That obtained for the antenna of FIG. 5 is referenced 62 on FIG. 6. It should be noted that with regard to these diagrams that the antenna of FIG. 5 provides better directivity than that of FIG. 4.

A second technique for manufacturing defects in the PBG cylindrical material consists in using metallic wires/bars which may be controlled, so-called active wires/bars, by implementation of active wires/bars including at least two conductive segments between which an insulator is inserted and parallel to the insulator, at least one active switching component (diode, transistor, MEMS . . . ) is inserted enabling according to the state of the component (conductive or non-conductive) to connect (radio)electrically both segments therebetween. Thus, relative to the control of the active component and hence of its state, the active wire/bar behaves like as if it were in a continuous state (conductive/reflective of the waves) or a discontinuous state (non-conductive of the waves and hence transparent for the waves). The wires/bars behave like wires/bars of discontinuous state, hence non-conductive at least for the radioelectric waves, constitute the defects. Relative to their position and to their configuration, one may select the width, the direction and the number of useful beams.

The antenna hence comprises control means of the active switching components, enabling, relative to the beam(s) to be created, to force certain of the active wires/bars to behave like wires/bars in a discontinuous state whereas the others are in a continuous state.

One may use as active switching components of the networks of biased PIN diodes by a direct current circulating in the metallic wires/bars. The control of these components (and hence of the wires/bars wherein they are comprised) may be realised by angular sectors (for example three sectors separated by 90° for producing three lobes in three directions) of the PBG cylindrical structure. For example, all the wires/bars of a sector switch simultaneously. This reduces the number of independent control circuits to the number of switchable sectors. One may also use photodiodes (possibly phototransistor) whereof the switching is obtained by optic fibre-supplied light.

In order to increase the possibilities in terms of beam shaping and of angular positioning in the plane xy, all the wires/bars may be of the type which may be controlled. On the other hand, within each wire/bar which may be controlled, the active switching components may be controlled as a whole or individually or by sections. In the first case, the whole wire/bar will be made conductive/reflective or non-conductive/transparent according to the control. In the latter case, the section(s) controlled will be made conductive/reflective or non-conductive/transparent according to the control (as indicated previously the length of the section should be large with respect to the wavelength). Thus, relative to the position of the section in height with respect to the plane xy, it will be possible, moreover, to direct in height the lobe(s) created. In the intermediary case with independent controls of each active switching component of a wire/bar, one may realise a block action as well as by sections (the controlled components will be adjacent and defining a sufficient section length with respect to the waves).

Figure 7:
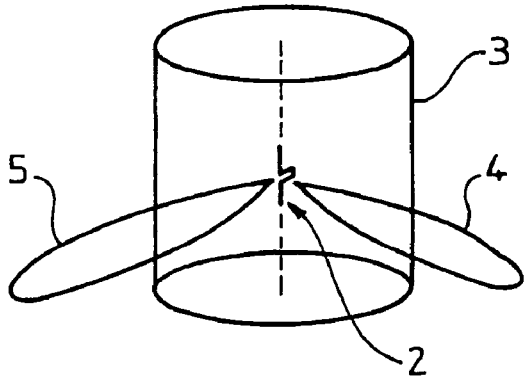
FIG. 7 which represents a schematic perspective view of an antenna according to the invention including a PBG cylindrical material.

The wires/bars arranged according to the external circle (of the largest radius) constitute a cylindrical envelope 3 of the structure, as illustrated on the schematic perspective view of FIG. 7. For simplification purposes, solely the external envelope 3 (without any representation of the wires/bars properly speaking), the radiating element 2 and two beams 4 and 5 have been represented.

Figure 8:
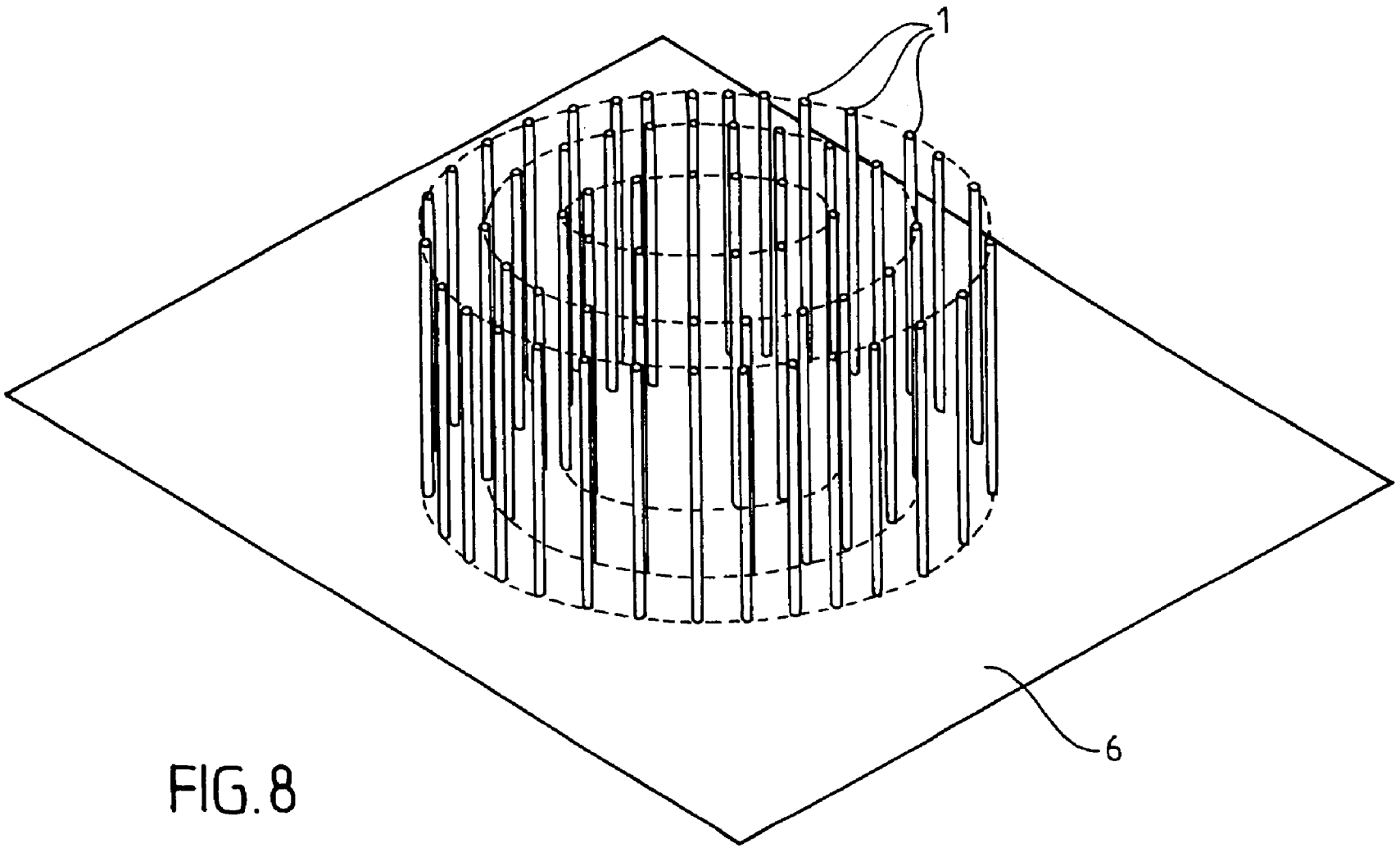
FIG. 8 which represents a real perspective view of an example of antenna according to the invention including a PBG cylindrical material.

The PBG cylindrical structure also appears on FIG. 8, which is a real perspective view of an example of antenna according to the invention. In this example, the PBG cylindrical structure comprises three concentric circles on each of which a plurality of wires/bars 1 are arranged. The conductive wires/bars are for example metallic wires/bars, arranged in the air or in a dielectric (for reducing the dimensions). In the case of the air, as illustrated on FIG. 8, the wires/bars are held by means of a support. This support is for example made of foam (of permittivity equivalent to that of the air). In the example illustrated, it comprises a horizontal plate or disc 6.

Figure 9:
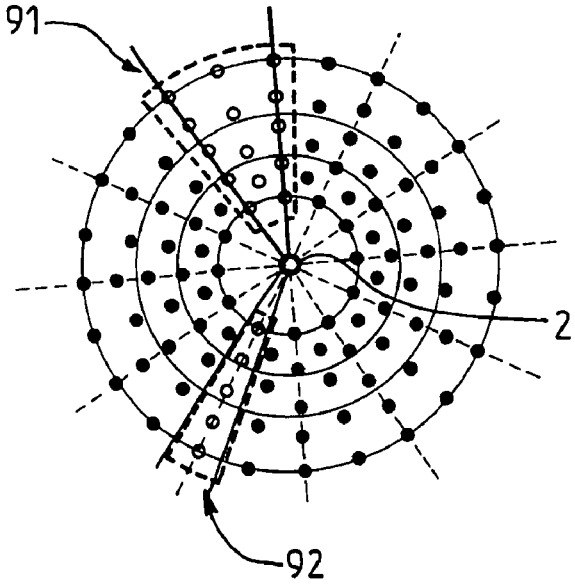
FIG. 9 which illustrates the operation of a beam-switching antenna.

We shall now describe, in relation with FIG. 9, the operation of a beam-switching antenna according to the invention, including a PBG cylindrical structure with defects obtained by wires/bars placed in a discontinuous state (hence transparent for the radioelectric waves) by control. Only a section of each of the lobes 91, 92 has been represented, the closest to the antenna. One should remark (FIG. 9 not representing the outermost section of the lobes) that it is preferable for obtaining a narrow lobe to have a sector of defects or formed of discontinuous wires/bars (transparent for the waves) which is open sufficiently rather than reduced to the minimum, i.e. for FIG. 9 formed of several adjoining carrying radii (lobe 91) rather than a single (lobe 92). One may compare the effects of this interaction phenomenon of the waves with the structure to that of the optic diffraction.

The control of the shaping of a beam is performed as follows. The PBG cylindrical structure is excited at the centre by an antenna with symmetrical revolution 2. At the beginning, all the active wires/bars 1 are in a continuous state (they are in that continuous state represented by a black sticker on FIG. 9) and behave like (radio) electric conductors/reflectors. To create a beam in a given direction, defects are created in this PBG cylindrical structure while the active switching components are applied the insulating state between segments of certain wires/bars which are oriented into the direction requested of the beam. These wires/bars go hence into a discontinuous state (they are in this discontinuous state represented by a white sticker on FIG. 9) and behave like (radio) electric non-conductors and appear substantially transparent for the radioelectric waves. One may thus direct the beam in all the directions of the space. There is also the possibility of having two or several beams simultaneously in different directions. Thus, in the example of FIG. 9, two beams 91 and 92 are created simultaneously.

Figure 10:
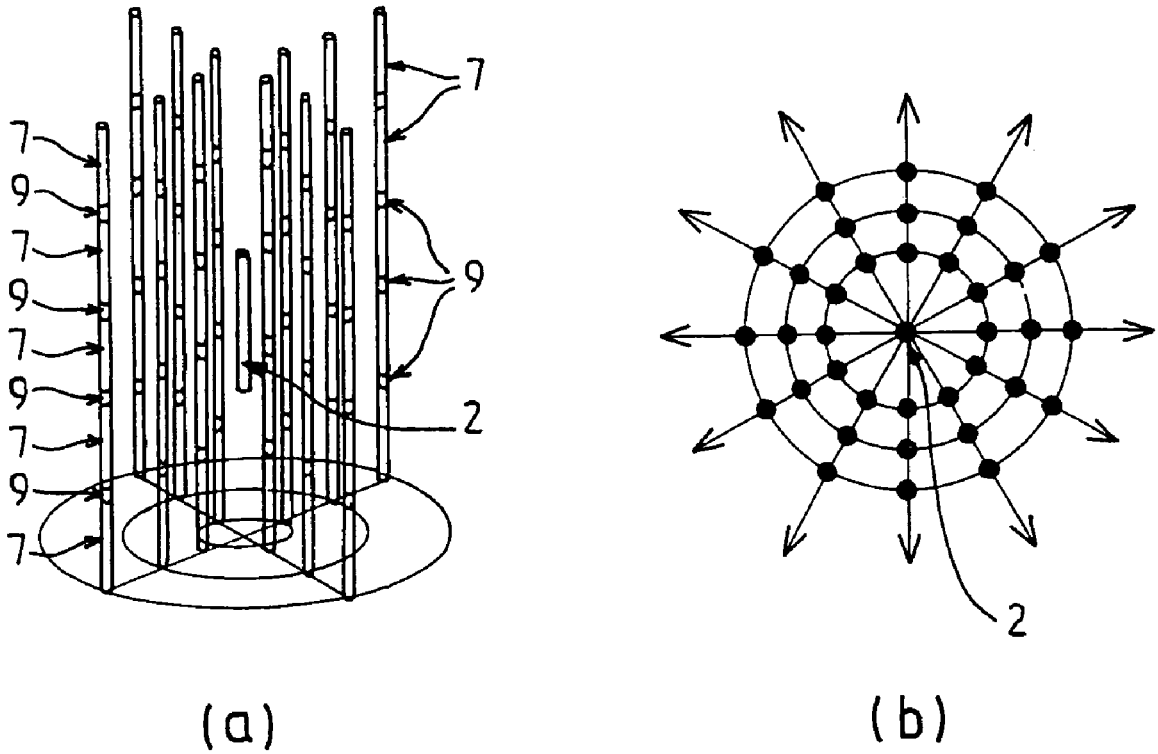
FIG. 10 which represents in (a) a perspective view of an antenna formed of a 90°-TSPBG material, the wires/bars being arranged on radii separated angularly by 90° and in (b) a top view of an antenna formed of a 30° TSPBG material, the wires/bars being arranged over radii separated angularly by 30°, FIG. 11 (*a*) to (*d*) which represents simulations of antennas 45°-BIPAC for different distributions of continuous and discontinuous wires/bars, FIG. 12 (*a*) to (*d*) which represents a simulation of a radiating element of single dipole type, FIG. 13 (*a*) to (*d*) which represents the simulation of a radiating element as that on FIG. 12 but placed within an antenna in a 45° TSPBG material, FIG. 14 (*a*) to (*d*) which represents the simulation of a radiating element as that of FIG. 12 but placed within an antenna in a 22.5° TSPBG material.

FIG. 10 represents two examples of antenna realised from TSPBG materials, the first in (a) with circular and radial distribution of angular 900 pitch and the second in (b) of 30° pitch. The wires/bars are formed of conductive segments 7 separated by diodes 9 and hence liable to be placed in a continuous state (conductive/reflective of the waves) or discontinuous (transparent for the waves) with respect to the bias or not of the diodes. The central radiating element is a dipole. It should be understood that this type of structure, in the case when the diodes may be controlled selectively (in a wire/bar: individually, per group or globally), enables to realise a wire/bar whereof one (several) section(s) may be rendered discontinuous with respect to the remainder of the wire/bar, a section corresponding to a portion (or entirety) of a wire/bar whereof the adjoining (contiguous) segments are insulated from one another (discontinuous) radioelectrically, the remainder of the wire/bar being continuous.

Figure 11:
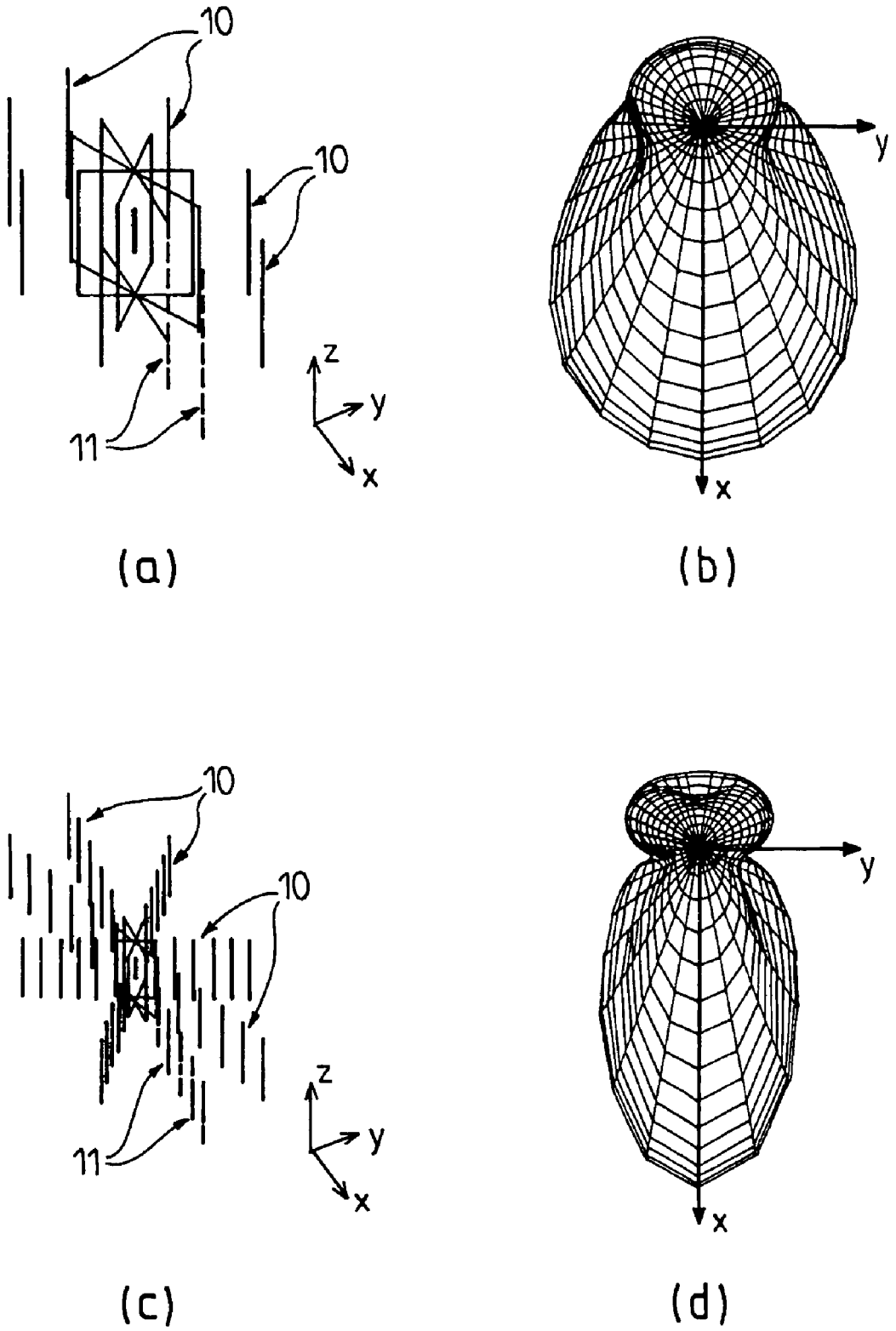

On FIG. 11 (*a*), the TSPBG material 45° of the antenna is a perspective view and all the wires/bars of both circular layers are in a continuous state 10 (conductive/reflective of the waves), except for those situated along a radius which are in a discontinuous state 11 (transparent for the waves). The radiation diagram for θ=90° is given to FIG. 11 (*b*) in dB. The greater axis of the radiation diagram is in the direction of the radius having the discontinuous wires/bars.

On FIG. 11 (*c*), the TSPBG material 45° of the antenna is a perspective view and all the wires/bars of the six circular layers are in a continuous state 10 (conductive/reflective of the waves), except for those situated along a radius which are in a discontinuous state 11 (transparent for the waves). The radiation diagram for 0θ=90° is given to FIG. 11 (*b*) in dB. The greater axis of the radiation diagram is in the direction of the radius having the discontinuous wires/bars.

It should be noted on FIG. 11 (*a*) and (*c*) that conductors are arranged at the upper and lower ends of the structure of antenna en radii from the (insulated) ends of the radiating element towards the wires/bars of the first circle, they constitute a wire ground plane limiting the propagation of the waves upwards and downwards of the antenna.

Figure 12:
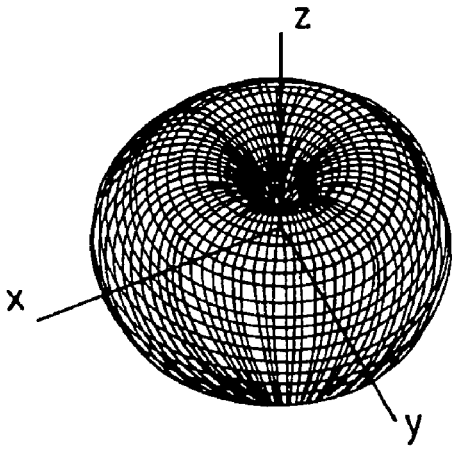
Figure 12:
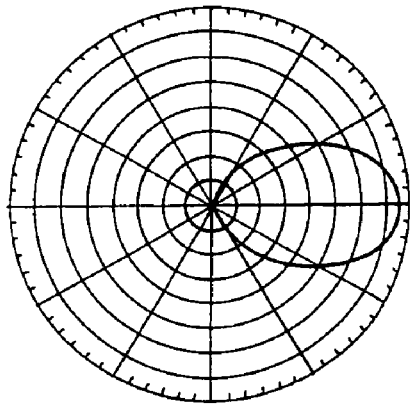
Figure 12:
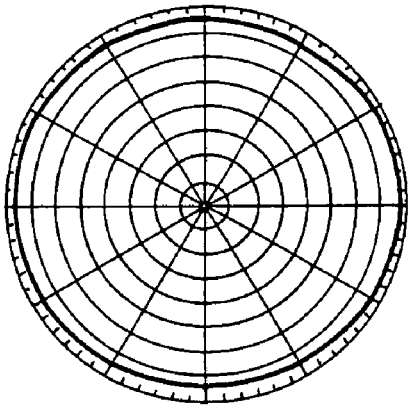
Figure 12:
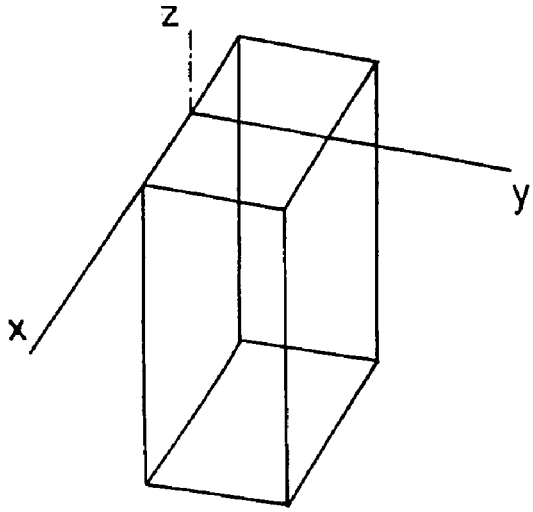

On FIG. 12 (*a*) to (*d*), the single dipole-type radiating element radiates at a frequency of 2 GHz and the length of the dipole is 75 mm in total. For reasons of symmetry and with the simulation software HFSS® only a quarter of the antenna is simulated (FIG. 12 (*d*)). FIG. 12 (*a*), the far-field radiation diagram forms a torus in this perspective view. FIG. 12 (*b*), the radiation diagram is a projection view for ϕ=0° and FIG. 12 (*c*) for θ=90°.

Figure 13:
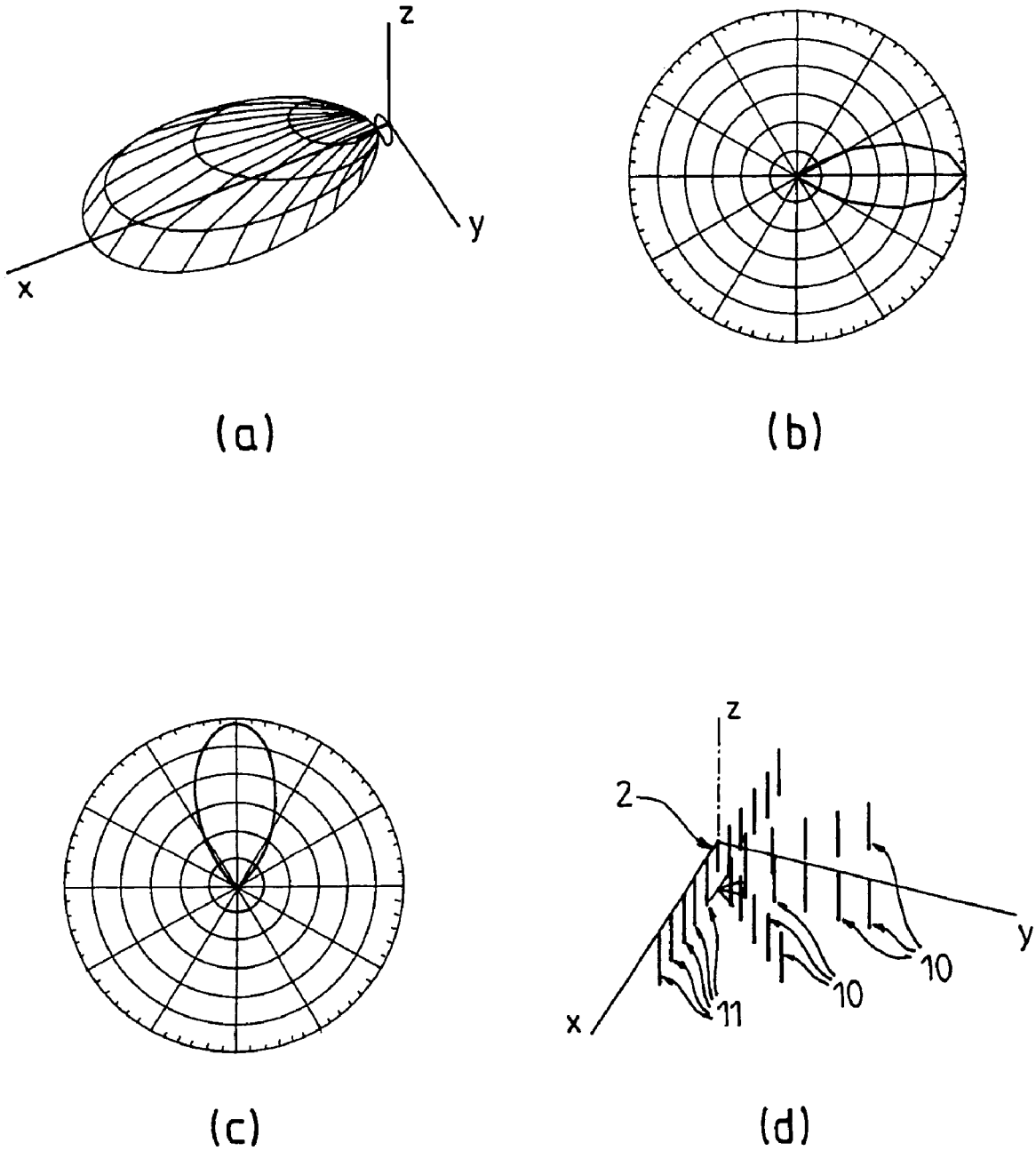

On FIG. 13 (*a*) to (*d*), the dipole radiates at a frequency of 2 GHz within a TSPBG material whereof the wires/bars are arranged on concentric circles along radii spaced angularly by 45°, all the wires being in a continuous state 10 (conductive/reflective of the waves) except for those of a radius which are in a discontinuous state 11 (transparent for the waves) and in the direction of which radius a lobe of the radiation diagram will be formed. For reasons of symmetry and with the simulation software HFSS® only a quarter of the antenna is simulated (FIG. 13 (*d*)). FIG. 13 (*a*), the far-field radiation diagram forms a lobe in this perspective view. FIG. 13 (*b*), the radiation diagram is a projection view for ϕ=0° and FIG. 13 (*c*) for θ=90°.

Figure 14:
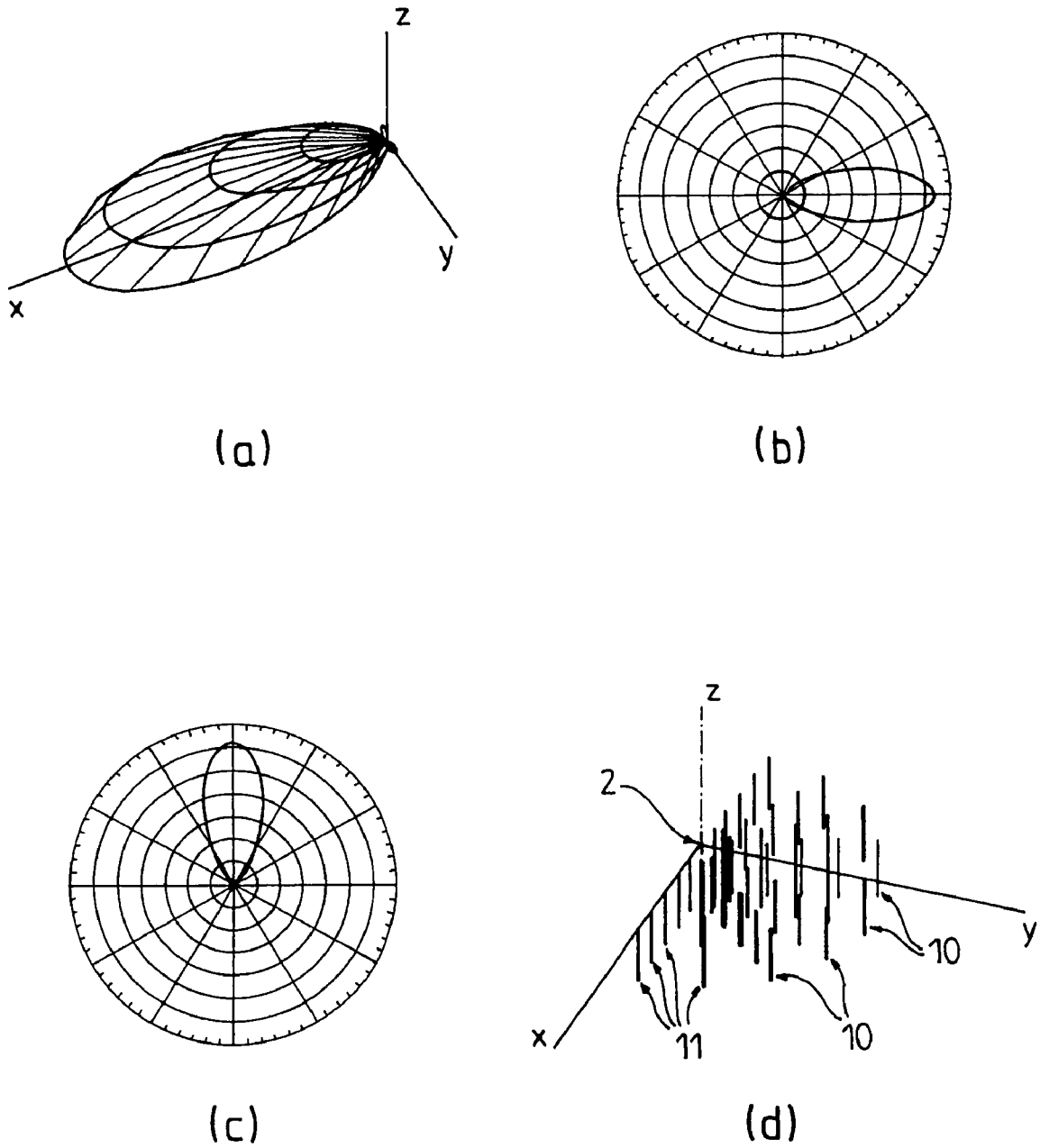

On FIG. 14 (*a*) to (*d*), the dipole radiates at a frequency of 2 GHz within a TSPBG material whereof the wires/bars are arranged on concentric circles along radii spaced angularly by 22.5°, all the wires being in a continuous state 10 (conductive/reflective of the waves) except for those of two adjoining radii which are in a discontinuous state 11 (transparent for the waves) and in the direction of which radii a lobe of the radiation diagram will be formed. For reasons of symmetry and with the simulation software HFSS® only a quarter of the antenna is simulated (FIG. 14 (*d*)). On FIG. 14 (*a*), the far-field radiation diagram forms a lobe in this perspective view. On FIG. 14 (*b*), the radiation diagram is a projection view for ϕ=0° and FIG. 14 (*c*) for θ=90°.

Since they enable dynamic change of the beam shaping, the control means may also constitute beam switching means. In other words, while modifying the control signals applied to the active components of the wires/bars of several elements, it is possible to switch between at least one first beam and at least one second beam. The beam-switching antenna thus obtained, according to the invention, may be implemented in particular, but non exclusively, in a base transceiver station of a radiocommunication system with mobile stations.

In the detailed examples which have been given, a particular case of antenna has been considered whereof the PBG elements are arranged regularly and according to a circular distribution in the form of a circle coaxially around a radiating element (omnidirectional dipolar single antenna) in order to simplify the explanations and the calculations. Indeed, the radiating element being omnidirectional and the regular arrangement of the PBG elements in concentric circles, one may limit the modelling calculations in certain sectors of space, in particular angular ones. One may also derive therefrom a revolution symmetry of the behaviour of the antenna.

It is considered however that other structures of antenna with PBG/TSPBG elements may be realised for obtaining different behaviours according to the angular directions contemplated although the continuous/discontinuous PBG materials are structured in an equivalent fashion but offset angularly: whereas the radiating element on its own may have a non-omnidirectional diagram and/or the PBG elements be arranged on elliptic curves (possibly, at the limit a circle) to constant eccentricity or not as moving away from the radiating element which is central. It then appears that the simulation and the radiation diagrams obtained may be more complex. This type of antenna may for example be used in a base transceiver station whereof the environment is inhomogeneous and comprises obstacles to the waves and/or mirror-effect constructions on the waves (reflection, multiple paths) and/or promoting the transmission (Rx/Tx at the sea-side: one may select to promote/fine-tune by defect the transmission inland rather than toward the sea).

On the other hand, a PBG material with linear wires/bars parallel to the radiating element (axis z) has been considered which enables the shaping of one or several lobes whereof the greater axis is substantially perpendicular to the radiating element, thereby enabling circular scanning of the great axis (axes) of the lobe(s) in a plane also perpendicular to the radiating element. One also considers within the framework of the invention that the PBG material includes parallel wires/bars which are not linear and, preferably, with wires/bars which are situated at least over a section of their paths substantially parallel to one another and over a circular curve of the circle type (wires/bars in arcs of circles), elliptic (wires/bars in arcs of ellipses). Such a structure in concentric spherical or elliptic shells of wires/bars, in addition to the possibility of shaping of lobe(s) in a plane perpendicular to the radiating element (plane xy) enables better shaping of the lobes in height relative to the plane xy (the lobes are in planes zw; w being a centred axis running through the plane xy), thereby enabling volume scanning of the greater axis of the lobe(s) in space. In the latter case, the selection of the continuous or discontinuous state for a wire/bar is conducted preferably per sections according to a position determined in height. Thus, one may for example realise antennas wherein wires or bars are arranged in spherical layers around an omnidirectional antenna. As previously, the antenna will radiate solely in the directions of which wires/bars or sections of wires/bars are (radio)electrically non-conductive. It is also possible, as already seen, to scan a section of the space with one/several lobes even with linear wires/bars controlled per sections.

It should be understood that the general form of the wires/bars, in particular towards their upper and/or lower ends, may depart from the shapes indicated below (linear, circle or ellipse), in order to obtain even more particular a behaviour of the lobe(s) upwardly and/or downwardly of the antenna by implementation of shapes of particular wires/bars and, for example, (associated or not to the previous shapes, linear, circle, ellipse) in triangle, square or rectangle (in particular in the case when ground planes are available at both axial ends of the antenna for limiting the radiation upwardly or downwardly). It may be indeed necessary to have an incidence handling of the antenna which is improved in particular in the case of radome applications for an omnidirectional antenna and in this case it is necessary to use a network of three-dimensional structure, formed of planes of wires/bars crossing each other at right angles.

Similarly, the invention may be applied in associations of antennas realised according to the distribution features on circular curves (circle or ellipse or other closed curved shape) of wires/bars, wires/bars being common to two (or more) separate radiating elements, the distribution curves for each of the radiating elements crossing one another at said common wires/bars.

The invention claimed is:

1. An antenna enabling the shaping of at least one beam of radioelectric waves (4, 5, 61, 62, 91, 92) of at least one determined wavelength, of the type comprising at least one radiating element (2) the waves, placed in a set of wires or bars (1) reflective of the wave and substantially parallel to one another, made of a Photonic Band Gap (PBG) material and forming a determined structure, said determined structure including defects so as to shape said at least one beam in a direction relative to the position and/or of the configuration of said defects, wherein said wires or bars and the defects are arranged on a set of N concentric closed curves of a plane, N being greater than or equal to two, the radiating element being arranged inside the innermost curve and the distance between the curves is smaller than a quarter of the wavelength, the length of a wire/bar being greater than or equal to half the wavelength.

2. The antenna according to claim 1, wherein the curves are selected among the circles, the ellipses, the cycloids and, are all circles, the radiating element being placed substantially in the common centre of said circles.

3. The antenna according to claim 1, wherein the wires/bars or defects adjoining a given curve are arranged in transversally equidistant locations.

4. The antenna according to claim 3, wherein the transversal distance of the adjoining wires/bars or defects are all equal for all the curves.

5. The antenna according to claim 4, wherein the curves are circles and that the wires/bars or defects are arranged in at least two concentric circles around the radiating element substantially central according to a constant transversal periodic distribution, equal for all the circles.

6. The antenna according to claim 1, wherein the wires/bars or defects are arranged along distribution axes running through the radiating element and in the plane, in points corresponding to the crossing of the curves and of the distribution axes.

7. The antenna according to claim 6, wherein the distribution axes are spaced regularly in the plane over 360° and divide it into equal angular sectors, the value of an angular sector being 22.5° or a multiple of 22.5°.

8. The antenna according to claim 7, wherein the curves are circles and that the wires/bars or defects are arranged in at least two concentric circles around the radiating element substantially central according to a constant angular periodic distribution, equal for all the circles.

9. The antenna according to claim 1, wherein the radiating element is omnidirectional and is a dipole, said dipole being than arranged substantially parallel to the wires/bars.

10. The antenna according to claim 1, wherein the wires/bars are straight.

11. The antenna according to claim 1, wherein the wires/bars are curved.

12. The antenna according to claim 1, wherein said defects are realised by removing at least partially certain of said wires/bars, said at least one beam being shaped in a direction relative to the position and/or of the configuration of the wires/bars withdrawn.

13. The antenna according to claim 1, wherein at least certain of said wires/bars are each formed of at least two conductive segments, the maximum length of a segment being smaller than a quarter of the wavelength and smaller than or equal to the tenth of the wavelength, the adjoining segments of a wire/bar being separated by insulators, each wire/bar with several insulated segments therebetween, designated discontinuous wire/bar (11), being transparent for the wave and equivalent to the defect of a wire/bar at least partially withdrawn.

14. The antenna according to claim 13, wherein all the wires/bars are wires/bars with several segments.

15. The antenna according to claim 13, wherein at least one of the insulators separating two adjoining segments in a wire/bar comprises or is formed of a switchable active component which adopts at least one first conductive state for the wave, wherein the wire/bar with several segments behaves like a reflector, designated continuous wire/bar (10), and a second insulating state for the wave wherein the wire/bar with several segments is transparent for the wave and equivalent to the defect of a wire/bar at least partially withdrawn, and in that said antenna includes moreover control means of said active components, enabling to force certain of said wires/bars with several segments to behave like discontinuous wires/bars (11), said at least one beam being shaped in a direction relative to the position and/or the configuration of the discontinuous wires/bars.

16. The antenna according to claim 15, wherein in a wire/bar with segments and active switching components, the control is conducted by section(s) formed of a sub-assembly of adjoining segments of the assembly of the segments of the wire/bar, whereas the sub-assembly includes from two up to the total number of segments of the wire/bar, the components separating the segments of a section being placed into their first state, the other components being in the second state, in order to be able moreover to direct the beam(s) in height relative to the plane.

17. The antenna according to claim 15, wherein the control means of the active components constitute shaping and switching means between at least one first beam and at least one second beam, so that said antenna is a beam-switching antenna.

18. The antenna according to claim 1, wherein it is in a public or private civilian telecommunication network.

19. A base transceiver station of a radiocommunication system with mobile stations, wherein it includes at least one beam-switching antenna according to claim 17.

20. The antenna according to claim 1, wherein the radiating element is passive.

* * * * *

UNITED STATES PATENT AND TRADEMARK OFFICE

CERTIFICATE OF CORRECTION

PATENT NO. : 7,636,070 B2
APPLICATION NO. : 10/580338
DATED : December 22, 2009
INVENTOR(S) : De Lustrac et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 584 days.

Signed and Sealed this

Twenty-first Day of December, 2010

David J. Kappos

David J. Kappos
*Director of the United States Patent and Trademark Office*